US009377273B1

(12) United States Patent
Loper

(10) Patent No.: US 9,377,273 B1
(45) Date of Patent: Jun. 28, 2016

(54) ALIGNMENT TOOL FOR SCOPE AND RELATED METHODS

(71) Applicant: Brian P. Loper, Indian Springs, AL (US)

(72) Inventor: Brian P. Loper, Indian Springs, AL (US)

( * ) Notice: Subject to any disclaimer, the term of this patent is extended or adjusted under 35 U.S.C. 154(b) by 162 days.

(21) Appl. No.: 14/469,235

(22) Filed: Aug. 26, 2014

(51) Int. Cl.
*F41G 1/54* (2006.01)
*G01B 11/27* (2006.01)

(52) U.S. Cl.
CPC ..... *F41G 1/545* (2013.01)

(58) Field of Classification Search
CPC ..... F41G 1/38; F41G 1/54; F41G 1/545; F41G 3/32; F41G 3/323; F41G 3/326; G01B 11/27
USPC ..... 33/228, 286, 645, DIG. 21; 356/153
See application file for complete search history.

(56) References Cited

U.S. PATENT DOCUMENTS 4,095,347 A * 6/1978 Steffan ..... F41G 1/54 33/295
5,442,860 A * 8/1995 Palmer ..... F41G 1/545 33/286
5,499,455 A 3/1996 Palmer
5,878,504 A * 3/1999 Harms ..... F41G 1/545 33/286
6,025,908 A 2/2000 Houde-Walter
6,366,349 B1 4/2002 Houde-Walter
7,929,150 B1 4/2011 Schweiger
8,353,454 B2 1/2013 Sammut et al.
8,378,279 B2 2/2013 Mourar et al.
8,459,552 B2 6/2013 Arbouw
8,474,173 B2 7/2013 Matthews et al.
8,561,341 B1 * 10/2013 Dihlmann ..... F41G 1/545 42/120
8,800,154 B2 * 8/2014 Schmidt ..... F41G 1/545 33/286
9,285,189 B1 * 3/2016 Zhang ..... F41G 1/54
2012/0126001 A1 5/2012 Justice et al.

* cited by examiner

*Primary Examiner* — R. A. Smith

(74) *Attorney, Agent, or Firm* — Bush Intellectual Property Law; Kenneth M. Bush

(57) ABSTRACT

An alignment tool for alignment of a scope mounted to a rail of a firearm is disclosed herein. In various aspects, the alignment tool includes a support removably securable to a rail of a firearm, and a laser line generator adjustably positionably attached to the support. The laser line generator may project a line having a known geometric relationship to the rail, and a reticle of the scope mounted to the rail may be aligned with the line. Related methods of use are disclosed herein.

17 Claims, 5 Drawing Sheets

ALIGNMENT TOOL FOR SCOPE AND RELATED METHODS

BACKGROUND OF THE INVENTION

1. Field

The present disclosure relates to optical scopes for firearms, and, in particular, tools and associated methods for checking the alignment of a reticle with the firearm.

2. Background

Reticles (crosshairs) of a scope may become misaligned with the firearm to which the scope is mounted. For example, reticles can fail by moving in their mounts inside the scope tube after recoil from firing of the firearm or other impacts such as dropping the firearm or jostling during transport. Reticles may not maintain a consistent position throughout windage or elevation adjustment, for example, due to manufacturing defects. In addition, the scope may move within its mount, for example, due to shock or vibration during firing, transport, and so forth. Movement of the reticles within the scope, movement of the scope within its mount, or movement of the mount with respect to the firearm may result in misalignment of the reticles with the firearm.

Misalignment of the reticles with the firearm may be difficult for the user to recognize because there are no reference points with which to compare the reticles. Misalignment of the reticles with the firearm will affect the accuracy of the firearm since the reticles are no longer at the original sighted position. Accuracy errors increase the greater the distance being shot. Correction of the misalignment of the reticles with the firearm may be difficult to accomplish accurately particularly in the field.

Accordingly, there is a need for improved apparatus as well as related methods that allow for the alignment of the reticles with the firearm.

BRIEF SUMMARY OF THE INVENTION

These and other needs and disadvantages may be overcome by the apparatus and related methods disclosed herein. Additional improvements and advantages may be recognized by those of ordinary skill in the art upon study of the present disclosure.

An alignment tool for alignment of a scope mounted to a rail of a firearm is disclosed herein. In various aspects, the alignment tool includes a support removably securable to a rail of a firearm, and a laser line generator adjustably positionably attached to the support. The laser line generator may project a line having a known geometric relationship to the rail, and a reticle of the scope mounted to the rail may be aligned with the line. Related methods of use are disclosed herein.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1A:
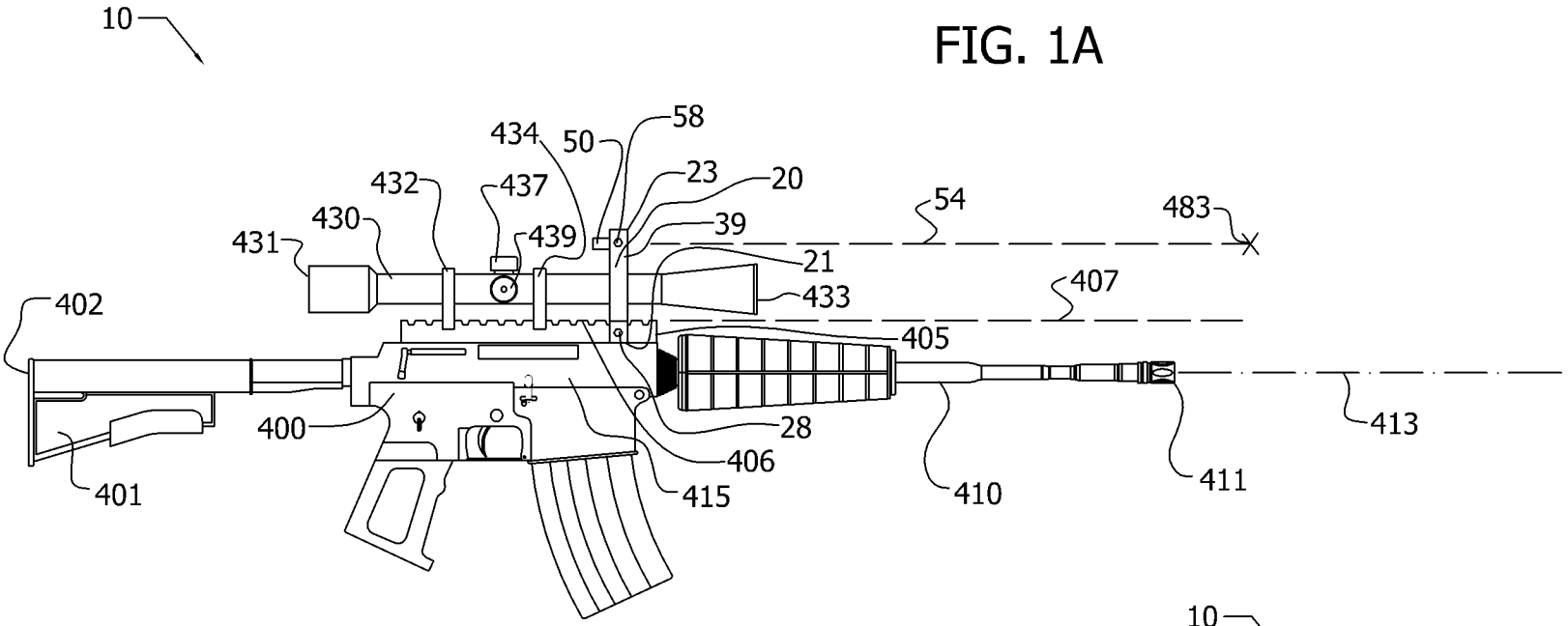
FIG. 1A illustrates by side elevation view an exemplary implementation of an alignment tool.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

An alignment tool for the alignment of a reticle of a scope mounted to a firearm is disclosed herein. In various aspects, the alignment tool mounts detachably to the rail of a firearm, and may be repeatedly mounted to the rail and detached from the rail. The alignment tool includes a laser line generator that projects a line onto a surface, in various aspects. In various aspects, the line projected by the laser line generator has a known geometric relationship with the rail, and, thus, the line provides a reference for alignment of the reticle with the rail. For example, the line may be oriented perpendicular to an axis of the rail, in various aspects, and the line may be either parallel to a top of the rail or perpendicular to the top of the rail. A reticle of a scope mounted onto the rail may be aligned with the line to align the reticle with the axis of the rail. In various aspects, the alignment tool may include a pivotable laser mount to which the laser line generator is mounted to allow the laser line generator to be adjustably positionable by pivoting the mount while continuously projecting the line, which allows the reticle(s) to be aligned with the line throughout the full range of adjustment of the reticle(s).

The alignment tool disclosed herein, in various aspects, does not require the firearm to be leveled, and the alignment tool may, for example, be used to align reticle(s) of the scope with the rail even if the firearm is canted or lying on its side. The alignment tool may be used to align the scope with the rail during initial mounting of the scope to the firearm. In addition, the alignment tool may be used to check the alignment of reticle(s) with the rail in the field. The alignment tool may be attached to the rail while the alignment tool is in use, the alignment tool may be removed from the rail when not in use, and the scope may remain mounted to the rail and operational while the alignment tool is attached to the rail. The alignment tool establishes a standard to which reticles may be repeatably aligned by repeatably projecting a line onto a flat surface using the laser line generator, in various aspects.

Firearm, as used herein, includes, for example, rifles, pistols, or other barreled weapons capable of launching one or more projectiles using explosive force. Firearm may further include, for example, rifles or pistols wherein the projectile is launched using compressed gas such as compressed air or compressed $CO_2$.

Rail, as used herein, refers to a Picatinny Rail ((US)Mil-Std-1913) or ((NATO) STANAG 4694) that may be machined into a receiver of the firearm, or that may be a machined metal fixture mounted with mounting screws to pre-positioned tapped holes in the receiver provided by the manufacturer. The rail includes a flat surface with recoil grooves and grabbers having V-angles. The dimensions of the rail including the flat surface, recoil grooves, and grabbers including the V-angles are defined by the ((US)Mil-Std-1913) or ((NATO) STANAG 4694) standards. The rail may be centered along the top of the receiver and the rail may extend the length of the receiver.

Figure 1B:
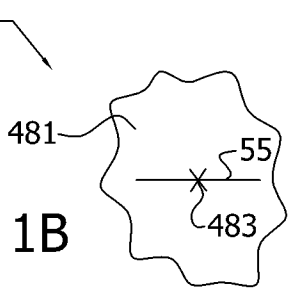
FIG. 1B illustrates a detail of the exemplary implementation of FIG. 1A.

FIGS. 1A and 1B illustrates an implementation of alignment tool 10. As illustrated in FIG. 1A, rail 405 is mounted to receiver 415 of firearm 400. Scope 430 is mounted to rail 405 by ring mounts 432, 434, and rail 405 is mounted to receiver 415 to mount scope 430 to receiver 415 of firearm 400, as illustrated. Eyepiece 431 of scope 430 is oriented generally toward butt 402 of stock 401 of firearm 400, and objective 433 of scope 430 is oriented toward muzzle 411 of firearm 400, as illustrated.

As illustrated in FIG. 1A, support 20 of alignment tool 10 is mounted to rail 405 of firearm 400. End 21 of support 20 is attached to rail 405 using fitting 25, which is removably securable to arm 34 of support 20 (see FIGS. 2 and 4), and end 23 of support 20 extends beyond scope 430, as illustrated.

Laser line generator 50 is mounted to support 20 to project a line, such as line 55, on flat surface, such as flat surface 481, as illustrated in FIG. 1B. Flat surface 481, as illustrated in FIG. 1B, is generally perpendicular to axis 413. Flat surface 481 may be, for example, a wall, a side of a vehicle, or other surface suitable for the projection of line 55 thereupon by laser line generator 50. Point 483 represents a point on flat surface 481 upon which line 55 is projected by laser line generator 50. Point 483 is used for explanatory purposes to illustrate the linkage between FIG. 1A and FIG. 1B.

Laser line generator 50 is positioned above the axis 407 of rail 405 that passes axially along the centerline 417 of rail 405, and laser line generator 50 projects beam 54 with line 55 embedded therein, as illustrated in FIG. 1A. Beam 54 is parallel to axis 407 of rail 405, in this implementation. In various implementations, axis 407 of rail 405 may be generally parallel with axis 413 defined by barrel 410 of firearm 400 so that beam 54, axis 407, and axis 413 may be parallel with one another. Laser line generator 50 is aligned with surface 406 of rail 405, as illustrated, so that line 55 has a known geometric relationship with rail 405, which is parallel to lateral axis 419 (see FIG. 4) of surface 406 of rail 405.

Figure 4:
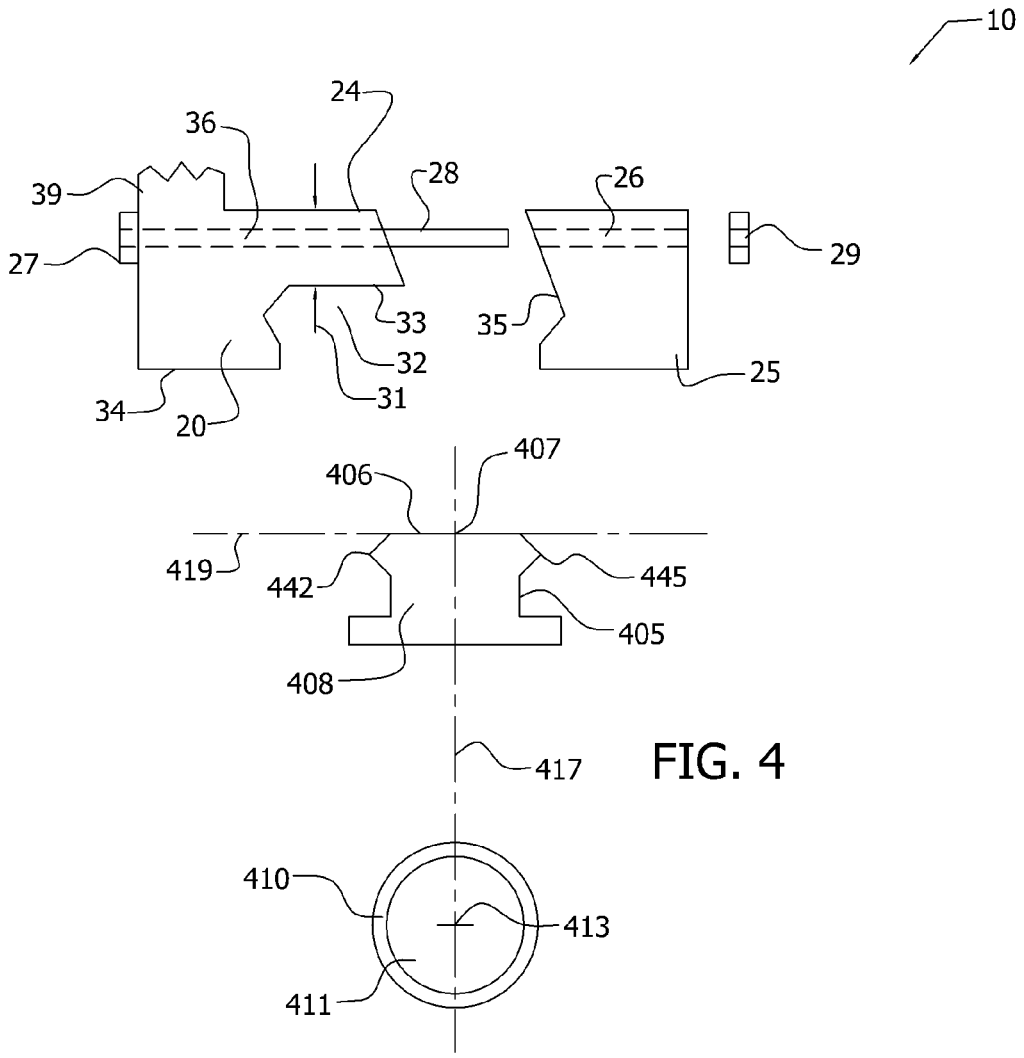
FIG. 4 illustrates by frontal view portions of the exemplary implementation of the alignment tool of FIG. 1A.
Figure 8A:
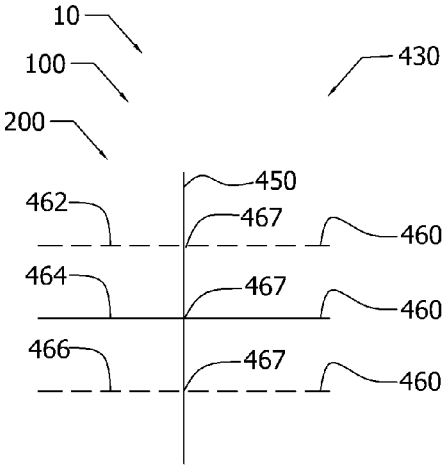
FIG. 8A illustrates schematically exemplary reticles within a scope including the range of elevation adjustment.

Accordingly by conforming reticle 460 of scope 430 with line 55, reticle 460 is trued to be in parallel to lateral axis 419 of surface 406 of the rail 405 to which the scope 430 is mounted, reticle 450 is aligned with centerline 417, and intersection 467 lies on centerline 417 (see FIGS. 4, 8A). If necessary, the mounts, such as ring mounts 432, 434 may be adjusted to bring the reticle 460 into alignment with line 55.

Laser line generators, such as laser line generator 50, are available, for example, from World Star Tech, Toronto, Ontario, Canada which manufactures various power and laser light spectrum line generators (for example, part no. UCL5-3.5G-635-25) with precision polished aspherical glass or cylinder lens. Laserline Optics Canada, Inc., Osoyoos, B.C., Canada is another laser line generator manufacturer. In various implementations, the laser line generator may generate either a single straight line or two straight lines perpendicular to one another to form a crosshair. Laser line generator 50 is illustrated in FIGS. 1A and 1B as projecting line 55, which is a single straight line in this implementation. In other implementations, the laser line generator may project lines at right angles to one another, such as reticles 450, 460 in FIGS. 8A, 8C.

Figure 2B:
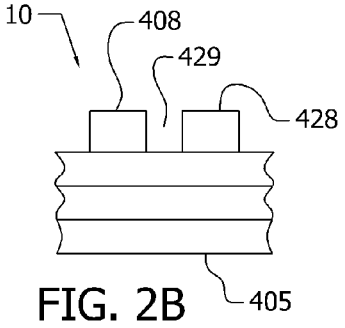
FIG. 2B illustrates by side view portions of a rail in conjunction with the exemplary implementation of the alignment tool of FIG. 1A.
Figure 2A:
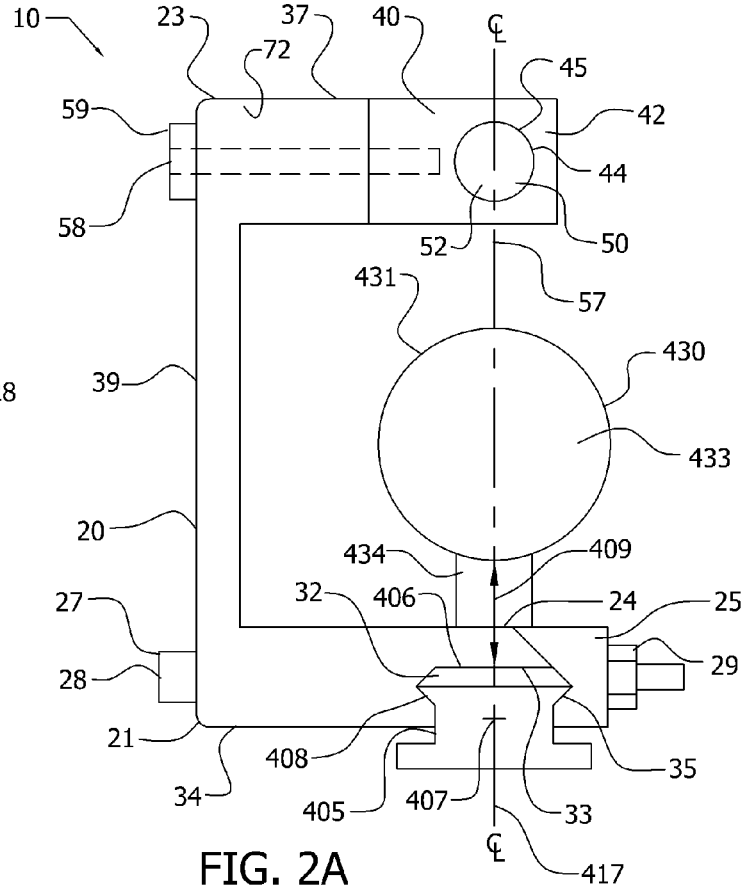
FIG. 2A illustrates by frontal view the exemplary implementation of the alignment tool of FIG. 1A.

FIG. 2A further illustrates alignment tool 10 mounted to rail 405. As illustrated in FIG. 2A, support 20 includes arm 34, arm 39 and arm 37 connected to one another to form a rigid structure. Arms 34, 39, 37 being generally straight and arms 34, 37 form right angles with respect to arm 37, in this implementation. Arm 39 connects arm 34 and arm 37 to one another to form a U-shaped member with arm 39 as the base of the U-shape, and arms 34, 37 set parallel to one another, in this implementation. Portions of arm 34 are sized to pass through gap 409 between outer surface 431 of scope 430 and surface 406 of rail 405, as illustrated in FIG. 2A. With portions of arm 34 passed through gap 409, end 24 of arm 34 is removably securable to rail 405 by fitting 25 to attach support 20 to rail 405.

As illustrated in FIG. 2A, arm 34 of support 20 is attached clampingly removably to grabber 408 of rail 405 by fitting 25, bolt 28, and nut 29. Slot 32 is formed by surface 33 at end 24 of support 20, in this implementation, and surface 33 of slot 32 conforms to portions of grabbers 408, 428 of rail 405 that fit within slot 32. Fitting 25 includes surface 35 that conforms to portions of grabbers 408, 428, as illustrated. Bolt 28, in this implementation, is sized to pass through gap 429. FIG. 2B illustrates a detail of rail 405 including grabbers 408, 428 separated by gap 429. In various implementations, arm 34 and fitting 25 may attach support 20 to rail 405 by engagement with grabbers 408, 428 and with bolt 28 passing through gap 429. In various other implementations, support 20 may be attached to rail 405 by engagement with several grabbers, such as grabbers 408, 428.

The portion of support 20 proximate end 24 that includes slot 32 is sized to pass through gap 409 between scope 430 and rail 405 to allow attachment of alignment tool 10 to rail 405 without removal of scope 430, as illustrated in FIG. 2A. Accordingly, end 24 may be inserted through gap 409 and then slot 32 engaged with grabber 408 of rail 405.

In this implementation, surface 33 of slot 32 is oriented to conform to portions of grabbers 408, 428, fitting 25 is oriented so that surface 35 conforms to portions of grabbers 408, 428 and fitting 25 is connected to end 24 of support 20 by bolt 28 that passes through gap 429 and is threadedly engaged with nut 29. By tightening of nut 29 on bolt 28, nut 29 biases against fitting 25 to bias fitting 25 against support 20 and surface 33 of support 20 and surface 35 of fitting 25 are biased accordingly against portions of grabbers 408, 428 to attach support 20 with fitting 25 to rail 405, and, thus, attach alignment tool 10 to rail 405. Loosening of nut 29 will disengage fitting 25 from support 20 and disengage surface 33 of support 20 and surface 35 of fitting 25 from bias against portions of grabbers 408, 428 to allow removal of alignment tool 10 from rail 405. Because end 24 may be inserted through gap 409 and slot 32 may be then engaged with grabbers 408, 428 of rail 405, alignment tool 10 may be attached to rail 405 or detached from rail 405 without removal of scope 430.

Nut 29 threadedly engages with bolt 28, in this implementation, and bolt 28 is slideably engaged with support 20 and with fitting 25. In other implementations, fitting 25 may be threadedly engaged with bolt 28 so that nut 29 may be omitted. In still other implementations, bolt 28 may be formed as a threaded rod threadedly received at end 24 of support 20 and that extends forth from end 24 of support 20 to receive fitting 25 and nut 29 thereupon. In still other implementations, support 20 may engage with one grabber, such as grabber 408, of rail 405 when attached to rail 405.

Laser mount 40 is secured to support 20 by bolt 58 that passes through arm 37 of support 20 to threadedly engage laser mount 40. Laser line generator 50 may be received in socket 44 of laser mount 40. Socket 44 is formed as a circular hole that passes through laser mount 40, and laser line generator 50 may be received in socket 44 by pressed fit between body 51 of laser line generator 50 and surface 45 of socket 44 (see FIG. 5). Lens 52 of laser line generator 50, as illustrated, is oriented in the same general direction as objective 433 of scope 430. With laser line generator 50 received in socket 44 of laser mount 40, laser mount 40 secured to arm 37 of support 20, and support 20 attached to rail 405, centerline 57 of laser line generator 50, which is essentially the centerline of socket 44, aligns with centerline 417 of rail 405, as illustrated. Beam 54 may be parallel to axis 407 of rail 405 depending upon the position of laser mount 40.

Bolt, such as bolt 28, 58, 158, 248, 268 may be any suitable fastener including, for example, a bolt or a screw, in various implementations. In various implementations, a head of the bolt, such as head 27, 59, may be formed as an external hexagonal head, or may be formed as an internal slotted head, hexalobular internal (torx) head, hex socket (Allen), Robertson, Phillips, or so forth, in various implementations. The head of the bolt may be formed to be grippable to allow hand tightening of the bolt, in various implementations. For example, the bolt may have a rounded head with a grippable circumferential surface. Nut, such as nut 29, may be a hexagonal nut, as illustrated in FIG. 2A, other fastener, or may be a wing nut, rounded nut with grippable circumferential surface, or other such grippable nut to allow hand tightening, in other implementations.

Figure 3:
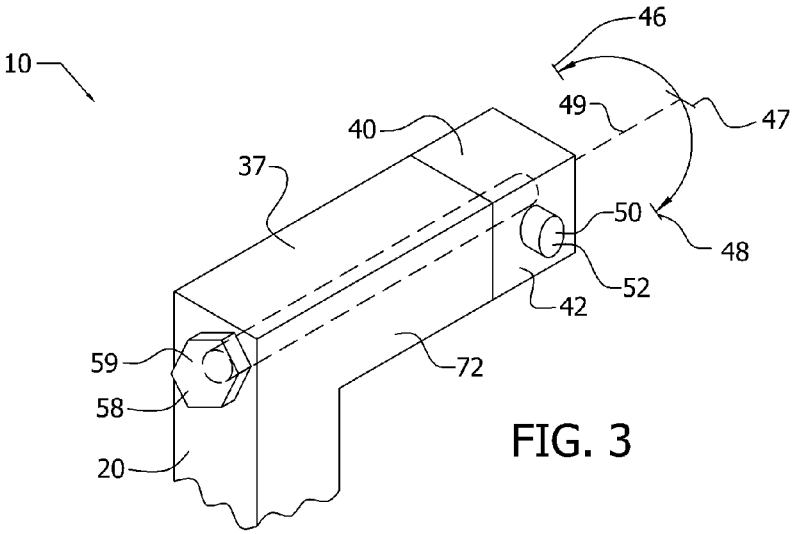
FIG. 3 illustrates by perspective view portions of the exemplary implementation of the alignment tool of FIG. 1A.

As illustrated in FIG. 3, laser mount 40 may be pivotably positionable with respect to axis 49, which is defined by bolt 58. When attached to arm 37 of support 20 by bolt 58, laser mount 40 may pivot about arm 37 between at least positions 46, 47, 48. Laser mount 40 may be releasably locked at the selected position 46, 47, 48 or positions intermediate of positions 46, 47, 48 by tightening of bolt 58 to hold laser mount 40 in biased frictional engagement with arm 37. Laser mount 40 may be released to pivot between at least positions 46, 47, 48 by release of bolt 58 to release laser mount 40 from biased engagement with arm 37. Position 47 may align beam 54 of laser line generator 50 to be in parallel with axis 407 of rail 405, and laser mount 40 is in position 47 when surface 42 of laser mount 40 is perpendicular to axis 407, which is indicated by the parallel alignment of surface 42 with surface 72 of arm 37, as illustrated. Note that line generator 50 extends forth from laser mount 40 perpendicular to surface 42 and beam 54 is perpendicular to surface 42, in this implementation. Positions 46, 48 may coincide with the limits of traversal of the reticle of scope 430.

FIG. 4 illustrates portions of arm 34 of support 20 and fitting 25. As illustrated in FIG. 4, surface 33 of slot 32 is formed to compressionably bias against surface 406 and against V-angle 442 of grabber 408 of rail 405. Surface 35 is formed to compressionably bias against V-angle 445 of grabber 408. Note that the dimensions of grabber 408 including the shapes and dimensions of V-angles 442, 445 and the dimension of surface 406 as well as dimensions of grabber 428 and gap 429 are defined by the ((US)Mil-Std-1913) or ((NATO) STANAG 4694) standards so that slot 32 including surface 33 and surface 35 of fitting 25 may be formed to mate in close tolerance with surface 406 and V-angles 442, 445 as well as with grabber 428. With fitting 25 disengaged from arm 34, thickness 31 of arm 34 in conjunction with surface 33 is sized to allow arm 34 to pass through gap 409 to engage with grabbers 408, 428. Arm 34 may be passed through gap 409 and oriented so that surface 33 engages surface 406 and V-angle 442. Then, fitting 25 may be engaged with bolt 28 and oriented so that surface 35 engages V-angle 445. Fitting 25 and arm 34 may then be drawn together using bolt 28 to attach the assembly of arm 34 and fitting 25 to grabber 408 (and grabber 428) by compressionably biasing surface 33 against surface 406 and against V-angle 442 and by compressionably biasing surface 35 against V-angle 445, respectively, to attach support 20 securely to rail 405. Bolt 28 passes through passage 36 of arm 34, gap 429, and passage 26 of fitting 25 to engage threadedly with nut 29, as illustrated.

FIG. 4 illustrates centerline 417 of rail 405 that passes through the midpoint of rail 405 defined with respect to the lateral dimension of rail 405, and forms a perpendicular to surface 406, as illustrated. Axis 407 passes along surface 406 axially through centerline 417, as illustrated. Centerline 417 of rail 405 aligns with axis 413 of barrel 410, as illustrated. Surface 406 defines lateral axis 419 that lies in the plane of surface 406 and is parallel with surface 406 in the lateral direction and perpendicular to centerline 417, as illustrated.

Figure 5:
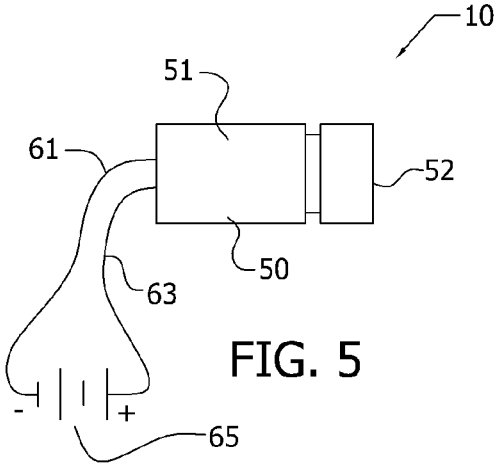
FIG. 5 illustrates portions of an exemplary laser line generator as used with the exemplary implementation of the alignment tool of FIG. 1A.

FIG. 5 illustrates an implementation of laser line generator 50 of alignment tool 10. As illustrated, laser line generator 50 is generally cylindrical in shape and the cylindrical shape may be received in socket 44 of laser mount 40 (see FIG. 3). Lens 52 is circular in shape, as illustrated, and electrical pathways 61, 63 connect to laser line generator 50 opposite of lens 52. The focus of lens may be adjusted to adjust the dimensions of line 55 depending upon the distance to surface 481. Electrical pathways 61, 63 communicate electrical power from battery 65, including mains electric or other electrical power sources, to laser line generator 50 to power laser line generator 50. Electrical pathways 61, 63 may include various switches, transformers, inverters, and so forth, as would be readily understood by those of ordinary skill in the art upon study of this disclosure.

Figure 6A:
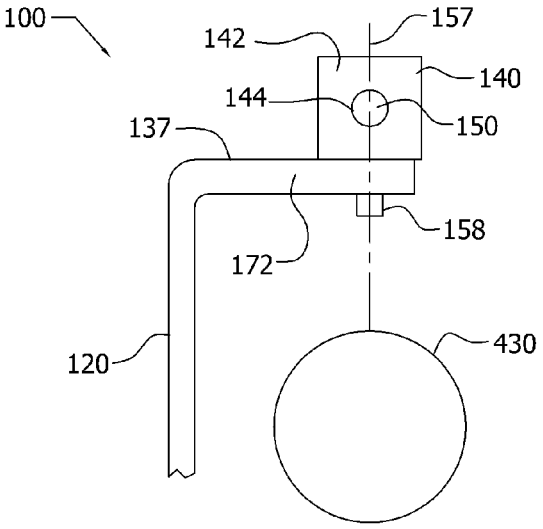
FIG. 6A illustrates by frontal view portions of another exemplary implementation of an alignment tool.
Figure 6B:
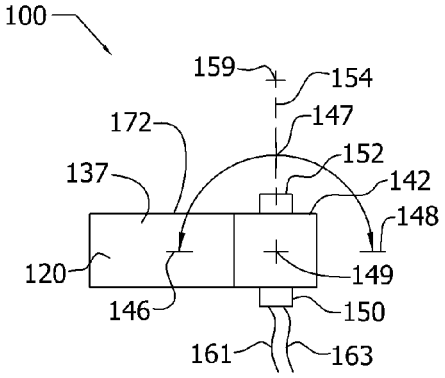
FIG. 6B illustrates by top plan view portions of the exemplary implementation of the alignment tool of FIG. 6A.

FIGS. 6A and 6B illustrate portions of an exemplary implementation of an alignment tool 100. As illustrated in FIGS. 6A and 6B, laser mount 140 is secured to support 120 by bolt 158 that passes through arm 137 of support 120 to threadedly engage laser mount 140 with arm 137. Laser line generator 150 is illustrated as received in socket 144 of laser mount 140. Beam 154 emanates from lens 152 of laser line generator 150, as illustrated, and electrical pathways 161, 163 extend from laser line generator 150 to communicate electrical power to laser line generator 150. Lens 152 of laser line generator 150, in this implementation, is oriented in the same general direction as objective 433 of scope 430.

Support 120 may be attached to rail 405 in the same manner as support 20 of alignment tool 10, in various implementations. With support 120 attached to rail 405, axis 157, which is defined as an axis of bolt 158, is coincident with centerline 417 of rail 405 and scope 430 is interposed between rail 405 and arm 137 including laser mount 140, as illustrated. Beam 154 emanating from laser line generator 150 is parallel to surface 406 of rail 405 and beam 154 is perpendicular to axis 157 and centerline 417 of rail 405.

As illustrated in FIG. 6B, laser mount 140 is pivotably positionable with respect to axis 149. When attached to arm 137 of support 120 by bolt 158, laser mount 140 may pivot about arm 137 between at least positions 146, 147, 148, as illustrated in FIG. 6B. Laser mount 140 may be releasably locked at the selected position 146, 147, 148 or positions intermediate of positions 146, 147, 148 by tightening of bolt 158 to hold laser mount 140 in biased frictional engagement with arm 137 at the selected position. Laser mount 140 may be released to pivot between at least positions 146, 147, 148 by release of bolt 158 to release laser mount 140 from biased engagement with arm 137. Position 147 may align beam 154 of laser line generator 50 to be in parallel with axis 407 of rail 405. Positions 146, 148 may coincide with the limits of traversal of the reticle of scope 430. Line 159 within beam 154 by laser line generator 150 is perpendicular to surface 406 of rail 405.

At position 147, line 159 is aligned with centerline 417. Laser mount 140 is in position 147 when surface 142 of laser mount 140 is in parallel alignment with surface 172 of arm 137, as illustrated in FIGS. 6A, 6B. Note that beam 154 is perpendicular to surface 142, in this implementation.

Figure 7:
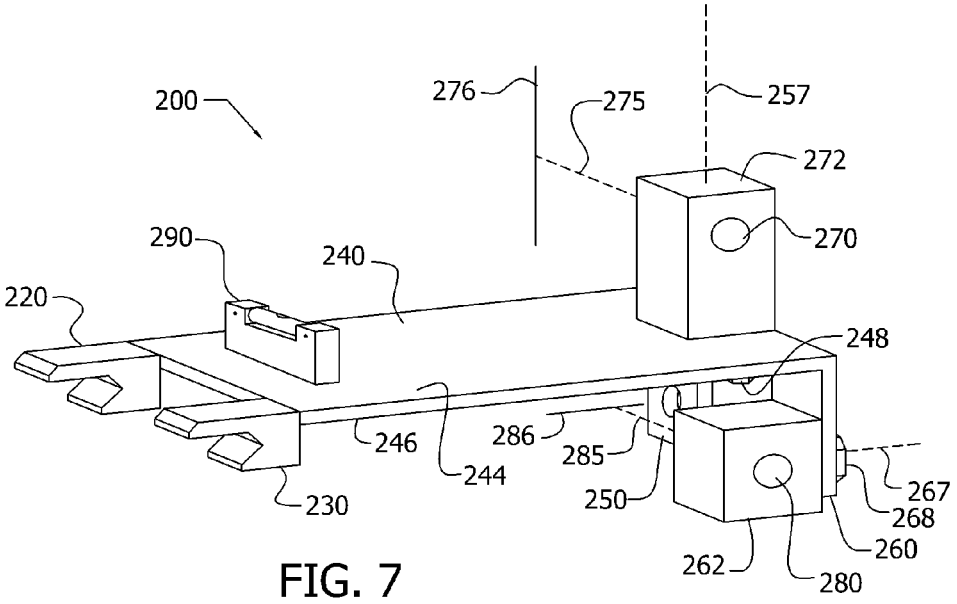
FIG. 7 illustrates by perspective view portions of yet another exemplary implementation of an alignment tool.

FIG. 7 illustrates an exemplary implementation of an alignment tool 200. As illustrated in FIG. 7, alignment tool 200 includes attachments 220, 230 that removably attach alignment tool 200 to rail 405. Either attachment 220, 230 or both attachments 220, 230 may be inserted through gap 409 to engage rail 405, and attachments 220, 230 are sized accordingly. Attachments 220, 230 may be attached to rail 405 on either side of the rail. Attachments 220, 230 are similar in design and operation to end 24 of support 20 of alignment tool 10, and fittings (not shown) similar to fitting 25 and bolts (not shown) similar to bolt 28 may be provided to attach one or both of attachments 220, 230 removably to rail 405. Attachments 220, 230 are shaped to mate with rail 405 similarly to end 24 of support 20.

With alignment tool attached to rail 405 by attachments 220, 230, surface 244 of plate 240 lies parallel to surface 406 of rail 405, and plate 240 extends to the side of firearm 400 generally parallel to surface 406. Surfaces 244, 246 are parallel to one another, as illustrated. Tabs 250, 260 are attached to surface 246 of plate 240, and tabs 250, 260 are perpendicular to surface 246 of plate 240, in this implementation.

As illustrated, laser mount 262 is rotatably lockably secured to tab 260 by bolt 268. In various implementations, laser mount 262 may be secured to either side of tab 260 or to either side of tab 250 using bolt 268 as selected by the user. Either of tabs 250, 260 may be omitted in various other implementations. Laser line generator 280 is received in laser mount 262 in the implementation illustrated in FIG. 7.

As illustrated in FIG. 7, laser mount 272 with laser line generator 270 mounted thereto is secured rotatably lockably to surface 244 of plate 240 by bolt 248. In other implementations, tabs 250, 260 may be attached to surface 244 and laser mount 272 secured rotatably lockably to surface 246 of plate 240 thus reversing the placement of tabs 250, 260 and laser mount 272 about plate 240.

Beams 275, 285 emanate from laser line generators 270, 280, respectively, and are generally aligned in parallel with axis 407 of rail 405, as illustrated, when plate 240 is attached to rail 405. Lines 276, 286 are projected upon a flat surface, such as flat surface 481, by laser line generators 270, 280, respectively. Axis 257 defined by bolt 248 is perpendicular to surface 406 of rail 405, in this implementation. Accordingly, beam 275 may be projected in a plane parallel to surface 406 of rail 405 by rotation of laser housing 272 about axis 257, as illustrated, and line 276 is perpendicular to surface 406 of rail 405. Surfaces of laser mounts 262, 272 may be aligned with surfaces of tabs 250, 260 or plate 240 to orient beams 275, 285.

Axis 267 defined by bolt 268 is perpendicular axis 407 of rail 405 and parallel to surface 406 of rail 405. Accordingly, beam 285 may be projected in a plane perpendicular to surface 406 of rail 405 by rotation of laser housing 262 about axis 267. Line 286 is parallel to lateral axis 419 of surface 406 of rail 405, as illustrated.

Level 290 may be placed upon surface 244 to level surface 244 of plate 240 with respect to the horizontal, and level 290 may be variously oriented about surface 244 to level surface 244 with respect to the horizontal. Level 290 may be, for example, a machinists level, bench level, plate level, or electronic level. Because surface 244 is parallel to surface 406 of rail 405 when plate 240 is attached to rail 405, leveling surface 244 with respect to the horizontal levels surface 406 of rail 405 with respect to the horizontal. The firearm 400 may be held in a padded vise including other securements when leveling surfaces 244, 406 with respect to the horizontal.

Operations of the alignment tool, such as alignment tool 10, 100, 200, are generally illustrated in FIGS. 8A, 8B, 8C, and 8D. As illustrated in FIG. 8A, scope 430 includes reticles 450, 460 that may be viewed by the user through eyepiece 431 (see FIG. 1A). Reticles 450, 460 are set perpendicular to one another, and intersection 467 may be used to aim the firearm 400. Reticle 450 is oriented vertically during aiming of firearm 400, and reticle 460 is oriented horizontally, as illustrated.

Reticle 460, as illustrated in FIG. 8A, may be adjusted between position 462 and position 466, which are illustrated in phantom, using the elevation adjustment 437 of scope 430 (see FIG. 1A). Position 464 indicates the position of reticle 460 at a zero point of elevation adjustment 437. Positions 462, 466 indicate the positions of reticle 460 at extremes of the elevation adjustment 437. Reticle 460 may be positioned at a selected position between position 462 and position 466 to account for the vertical trajectory of the projectile over the distance to the target when intersection 467 is aligned with the target. The selected position of reticle 460 may depend upon the distance to the target.

Figure 8B:
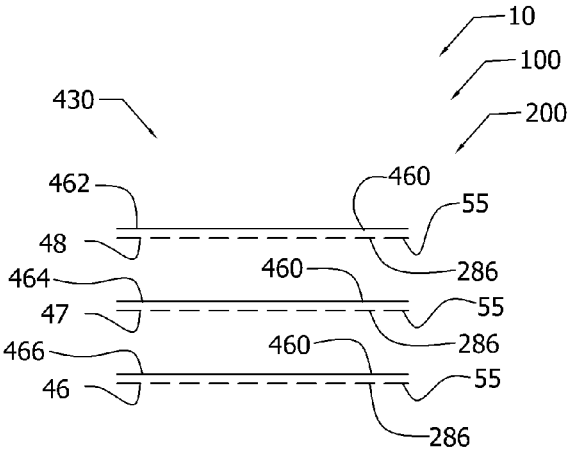
FIG. 8B illustrates schematically exemplary alignment of the reticle with a line throughout the range of elevation adjustment of the horizontal reticle using an exemplary alignment tool.

FIG. 8B illustrates a line, such as line 55, 286 in alignment with reticle 460. Note that the line, shown in phantom, is placed next to reticle 460, shown in solid, for the sake of explanation. The line may overlay reticle 460, and the line may or may not be parallel to reticle 460. When the line either overlays or is parallel to reticle 460, reticle 460 is aligned with the line and reticle 460 is, thus, parallel to lateral axis 419 (see FIG. 4) indicating reticle 460 is in alignment with lateral axis 419 of rail 405 of firearm 400. As illustrated in FIG. 8B, line 55 is positioned at position 48 that coincides with position 462 of reticle 460, at position 47 that coincides with position 464 of reticle 460, and at position 46 that coincides with position 466 of reticle 460. With reticle 460 at position 462, 464, 466 are aligned with the line (i.e. parallel to the line) at positions 48, 47, 46, respectively, reticle 460 is parallel to lateral axis 419 defined by surface 406 of rail 405.

As illustrated, positions 46, 48 of line 55 correspond to the range of adjustment of reticle 460 by elevation adjustment 437. The parallel relation between reticle 460 and the line, in this example, indicates that reticle 460 is in alignment with lateral axis 419 of rail 405 of firearm 400 throughout the range of elevation adjustment of reticle 460, as illustrated in FIG. 8B. Accordingly, scope 430 may be considered to be in proper alignment with rail 405 in this illustrated implementation. The user may thus check the alignment of reticle 460 with surface 406 of rail 405 throughout the range of elevation adjustment of reticle 460, which is between position 462 and 466.

If reticle 460 is not parallel with the line, then the mounting of scope 430 may be adjusted with respect to rail 405, or reticle 460 may be adjusted or replaced within scope 430, or both, to bring reticle 460 into alignment with the line, and, hence, with rail 405, in ways that would be understood by those of ordinary skill in the art upon study of this disclosure. Adjustment of the mounting of scope 430 may include adjustment of the scope 430 within the mounts 432, 434 and adjustment of the mounts 432, 434 with respect to the rail.

Figure 8C:
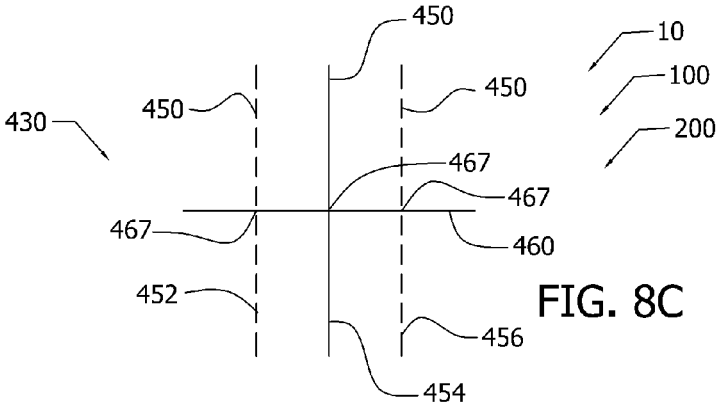
FIG. 8C illustrates schematically exemplary reticles within a scope including the range of windage adjustment; and, FIG. 8D illustrates schematically exemplary alignment of the reticle with a line throughout the range of windage adjustment of the horizontal reticle using an exemplary alignment tool.

As illustrated in FIG. 8C, reticle 450 may be adjusted between position 452 and position 456, which are illustrated in phantom, using the windage adjustment 439 of scope 430 (see FIG. 1A). Position 454 indicates the position of reticle 450 at zero point of windage adjustment 439. Positions 452, 456 indicate the positions of reticle 450 at extremes of the windage adjustment 439. Reticle 450 may be positioned at a selected position between position 452 and position 456 to account for the horizontal trajectory (windage) of the projectile over the distance to the target when intersection 467 is aligned with the target. The selected position of reticle 450 may depend upon the distance to the target and other conditions such as wind velocity.

Figure 8D:
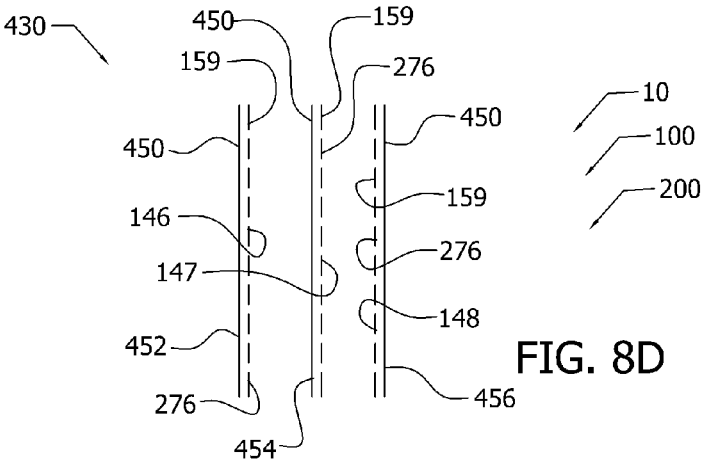

FIG. 8D illustrates a line, such as line 159, 276 in alignment with reticle 450. Note that the line, shown in phantom, is placed next to reticle 450, shown in solid, for the sake of explanation. The line may overlay reticle 450, and the line may or may not be parallel to reticle 450. As illustrated in FIG. 8D, line 159 is positioned at position 146 that coincides with position 452 of reticle 450, at position 147 that coincides with position 454 of reticle 450, and at position 148 that coincides with position 456 of reticle 450. As illustrated, positions 146, 148 of line 159 correspond to the range of adjustment of reticle 450 by windage adjustment 439.

With reticle 450 at position 452, 454, 456 are aligned with the line (i.e. parallel to the line) at positions 146, 147, 148, respectively, reticle 450 is perpendicular to surface 406 of rail 405. At position 147, reticle 450 may fall along centerline 417 of rail 405. (See FIG. 4). This allows the user to check the alignment of reticle 450 with surface 406 of rail 405 throughout the range of windage adjustment of reticle 450, which is between position 452 and 456. Note that if reticle 450 is perpendicular to surface 406 of rail 405 then reticle 460 is parallel to lateral axis 419, and vice versa.

If reticle 450 is not parallel with the line, then reticle 450 of scope 430 is not properly aligned with rail 405. The position of scope 430 may be adjusted with respect to rail 405, reticle 450 may be adjusted or replaced within scope 430, or both, in ways that would be understood by those of ordinary skill in the art upon study of this disclosure, to bring reticle 450 into alignment with the line, and, hence with rail 405.

In operation, an alignment tool, such as alignment tool 10, 100, 200, may be mounted to a rail, such as rail 405, of a firearm, such as firearm 400. A laser line generator, such as laser line generator 50, 150, 270, 280 may be used to generate a line, such as line 55, 159, 276, 286. The laser line generator may project the line onto a surface, such as surface 481. With the laser mount, such as laser mount 40, 140, 262, 272 placed at an intermediate position, such as position 47, 147, the beam, such as beam 55, 154, 275, 285, aligns in parallel with an axis of the rail, such as axis 407. With the laser mount at the intermediate position, the line may be either parallel to a lateral axis of the rail, such as lateral axis 419, or the line may be perpendicular to a surface of the rail, such as surface 406, and reticle 450 or reticle 460, respectively, may be aligned with the line to align the reticle with the rail. The laser mount may be rotated to shift the line through the range of windage adjustment or the range of elevation adjustment, and reticle 450 or reticle 460, respectively, may be compared with the line through the range of windage adjustment or the range of elevation adjustment. If the reticle, such as reticle 450, 460, is parallel with the line, the reticle is aligned with the rail. If the reticle is skewed with respect to the line, the mount of the scope on the rail, for example, may be adjusted or the reticle may be repaired or replaced.

Accordingly, reticles, which may be subjected to movement over time due to stresses from recoil as well as other shocks that occur during firearm transport or usage may be evaluated for parallel or perpendicular position with respect to the rail throughout the range of adjustment of the reticles. Long range shooters, military snipers, enthusiasts, and tournament competitors may thus confirm the alignment of reticle(s) with respect to the rail. If the reticle(s) are found to be out of alignment, corrective action may be taken to bring the reticle(s), the scope, or both into alignment with the rail.

The foregoing discussion along with the Figures discloses and describes various exemplary implementations. These implementations are not meant to limit the scope of coverage, but, instead, to assist in understanding the context of the language used in this specification and in the claims. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. An alignment tool, comprising:

a support removably securable to a rail of a firearm;

a laser line generator adjustably positionably attached to the support, the laser line generator adapted to project a line with which a reticle of a scope mounted to the rail may be aligned, the line having a known geometric relationship to the rail.

2. The apparatus of claim 1, wherein the line is parallel to a surface of the rail.

3. The apparatus of claim 1, wherein the line is perpendicular to a surface of the rail.

4. The apparatus of claim 3, the line lying along a centerline of the rail.

5. The apparatus of claim 1, wherein the line is positionable throughout a range of elevation adjustment of the reticle.

6. The apparatus of claim 1, wherein the line is positionable throughout a range of windage adjustment of the reticle.

7. The apparatus of claim 1, wherein the laser line generator is adjustably positionable about an axis perpendicular to a surface of the rail.

8. The apparatus of claim 1, wherein the laser line generator is adjustably positionably about an axis parallel to a surface of the rail.

9. The apparatus of claim 1, the support comprising a slot configured to conform to the geometry of the rail with portions of the support proximate the slot sized to pass between the scope and the rail for attachment to the rail when the scope is mounted to the rail.

10. The apparatus of claim 9, further comprising a fitting adapted for removable attachment to the support proximate the slot to attach the support removably to the rail.

11. The apparatus of claim 1, the support comprising a plate having a flat surface for placement of a level thereupon to allow orientation of the plate with respect to the horizontal.

12. The alignment tool of claim 1, the support having generally a U-shape to surround portions of the scope when the support is attached to the rail and the scope is mounted to the rail.

13. An alignment tool, comprising:

a laser line generator adjustably positionably removably securable to a rail of a firearm, the laser line generator when attached to the rail projects a line having a known geometric relationship to the rail that provides a reference with which a reticle of a scope mounted to the rail may be aligned.

14. The alignment tool of claim 13, further comprising:

a support to which the laser line generator is adjustably positionably attached, the support removably securable to the rail while the scope is attached to the rail, portions of the support sized to pass between the scope and the rail.

15. A method of alignment of a scope, comprising the steps of:

generating a line using a laser line generator, the line having a known geometric relationship with a rail of a firearm; and aligning a reticle of a scope mounted to the firearm with the line.

16. The method of claim 15, further comprising the steps of:

traversing the line through a range of elevation adjustment of the reticle; and aligning the reticle with the line throughout the range of elevation adjustment.

17. The method of claim 15, further comprising the steps of:

traversing the line through a range of windage adjustment of the reticle; and aligning the reticle with the line throughout the range of windage adjustment.

* * * * *